US005735016A

United States Patent [19]

Allen et al.

[11] Patent Number: 5,735,016

[45] Date of Patent: Apr. 7, 1998

[54] DUCT CLEANING APPARATUS

[75] Inventors: Bobby L. Allen; Joseph V. Melendres, both of Fort Worth, Tex.

[73] Assignee: Clean-Aire International, Inc., Ft. Worth, Tex.

[21] Appl. No.: 766,508

[22] Filed: Dec. 13, 1996

Related U.S. Application Data

[63] Continuation-in-part of Ser. No. 327,020, Oct. 21, 1994, Pat. No. 5,584,093.

[51] Int. Cl.[6] ..... B08B 9/04; A47L 7/00

[52] U.S. Cl. ..... 15/304; 15/339; 15/395; 134/113

[58] Field of Search ..... 15/304, 339, 395; 134/113

[56] References Cited

U.S. PATENT DOCUMENTS

| | | | |
|---|---|---|---|
| 2,193,999 | 3/1940 | Allen . | |
| 3,775,805 | 12/1973 | Mitchell . | |
| 3,800,358 | 4/1974 | Ryan . | |
| 3,946,459 | 3/1976 | Armstrong | 15/395 |
| 4,006,359 | 2/1977 | Sullins et al. . | |
| 4,473,921 | 10/1984 | Weber . | |
| 4,607,925 | 8/1986 | Kamigaichi et al. . | |
| 4,654,702 | 3/1987 | Tolino et al. . | |
| 4,661,848 | 4/1987 | Matsuda . | |
| 4,800,616 | 1/1989 | Wade . | |
| 4,972,363 | 11/1990 | Franklin et al. . | |
| 4,976,002 | 12/1990 | Leonov . | |
| 4,984,329 | 1/1991 | Wade . | |
| 4,995,201 | 2/1991 | von Borcke | 15/395 |
| 5,020,188 | 6/1991 | Walton . | |
| 5,072,487 | 12/1991 | Walton | 15/304 |
| 5,107,568 | 4/1992 | Wade . | |
| 5,109,567 | 5/1992 | Harrison | 15/406 |
| 5,195,209 | 3/1993 | Watkins . | |
| 5,311,641 | 5/1994 | Matsuura et al. . | |
| 5,317,782 | 6/1994 | Matsuura | 15/304 |
| 5,347,677 | 9/1994 | Prentice | 15/395 |
| 5,377,381 | 1/1995 | Wilson | 15/304 |
| 5,428,862 | 7/1995 | Sailer | 15/321 |
| 5,528,789 | 6/1996 | Rostamo | 15/395 |
| 5,561,883 | 10/1996 | Landry | 15/304 |
| 5,572,766 | 11/1996 | Matsuura | 15/304 |
| 5,584,093 | 12/1996 | Melendres . | |

FOREIGN PATENT DOCUMENTS

| | | |
|---|---|---|
| 9350 | of 1899 | United Kingdom . |
| 0002565 | 6/1985 | WIPO . |

*Primary Examiner*—Randall Chin
*Attorney, Agent, or Firm*—Martin Korn

[57] ABSTRACT

An apparatus for cleaning the interior surfaces of an air duct includes a housing. Brushes are mounted to the housing for sweeping engagement with the interior surfaces of the air duct. A video camera is mounted within the housing for generating an image of the interior of the air duct. A display displays the image generated by the video camera during an air duct cleaning operation.

2 Claims, 3 Drawing Sheets

DUCT CLEANING APPARATUS

RELATED APPLICATION

The present application is a continuation-in-part of U.S. application Ser. No. 08/327,020, filed Oct. 21, 1994, entitled "Duct Cleaning Apparatus" and now U.S. Pat. No. 5,584,093.

TECHNICAL FIELD OF THE INVENTION

The present invention relates to an air duct cleaning apparatus, and more particularly to an apparatus utilizing a video camera for viewing cleaning operations.

BACKGROUND OF THE INVENTION

Difficulty has been encountered in connection with the commercial cleaning of air ducts, such as, for example, hot air furnace ducts, air conditioning ducts, ventilating ducts, and the like, such as are commonly employed in office buildings, factories, foundries, and other commercial establishments as well as residential dwellings. Various methods are currently in use in connection with cleaning and conditioning such ducts, depending upon the size, cross-sectional shape and the linear paths along which such ducts extend.

Apart from strictly manual duct-cleaning operations, certain semi-automatic cleaning procedures have been developed. These procedures usually involve the manual feeding of a long flexible suction tube through the duct from different access openings. This procedure may be preceded by a dust loosening operation, utilizing long-handled brush arrangements which must be manipulated in order to ensure loosening of dust from the side, overhead, and floor surfaces of the duct.

Procedures may utilize rotary brushes which sweep circumferentially about the inner cylindrical walls of a conduit, and, together with suction heads withdraw the loosened dust and other foreign matter. Devices may be self-propelled through the conduit or pipe, or manually guided therethrough.

Although various duct cleaning procedures and apparatus exists, the quality of the cleaning operation is incapable of being determined in real time during the cleaning operation, as inspection of the duct is not possible. Visual inspection may be accomplished after the cleaning apparatus has been removed from a duct; however, such procedures require duplicative cleaning efforts, resulting in additional time required to clean ducts.

A need has thus arisen for a duct cleaning apparatus which provides the capability of making visual inspections during a cleaning operation to ensure proper and efficient cleaning of air ducts.

SUMMARY OF THE INVENTION

In accordance with the present invention, an apparatus for cleaning the interior surfaces of an air duct is provided. The apparatus includes a housing. Brushes are mounted to the housing for sweeping engagement with the interior surfaces of the air duct. A video camera is mounted within the housing for generating an image of the interior of the air duct. A display is provided for displaying the image generated by the video camera during an air duct cleaning operation.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
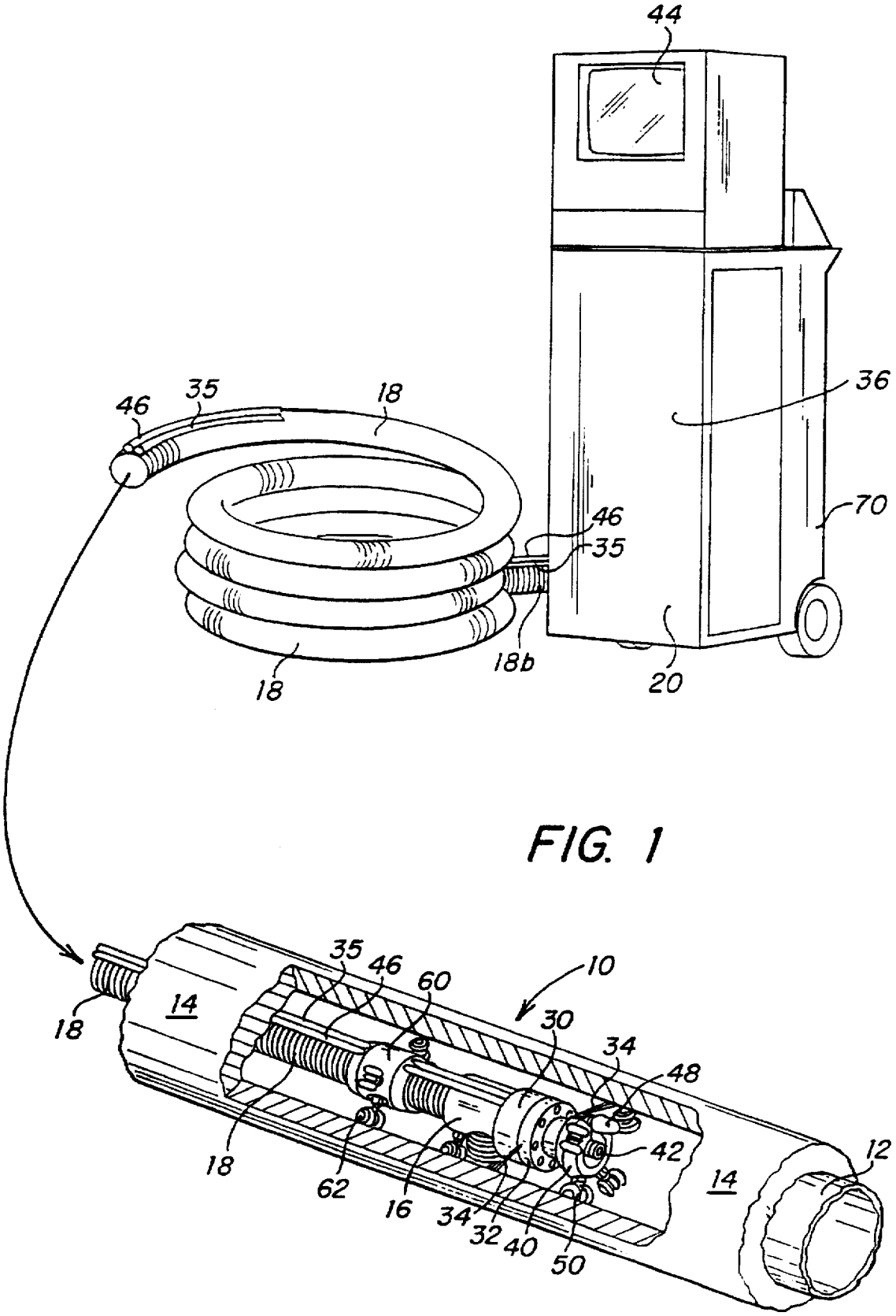
FIG. 1 is a perspective view of an apparatus illustrating a cleaning head disposed within an air duct.
Figure 2:
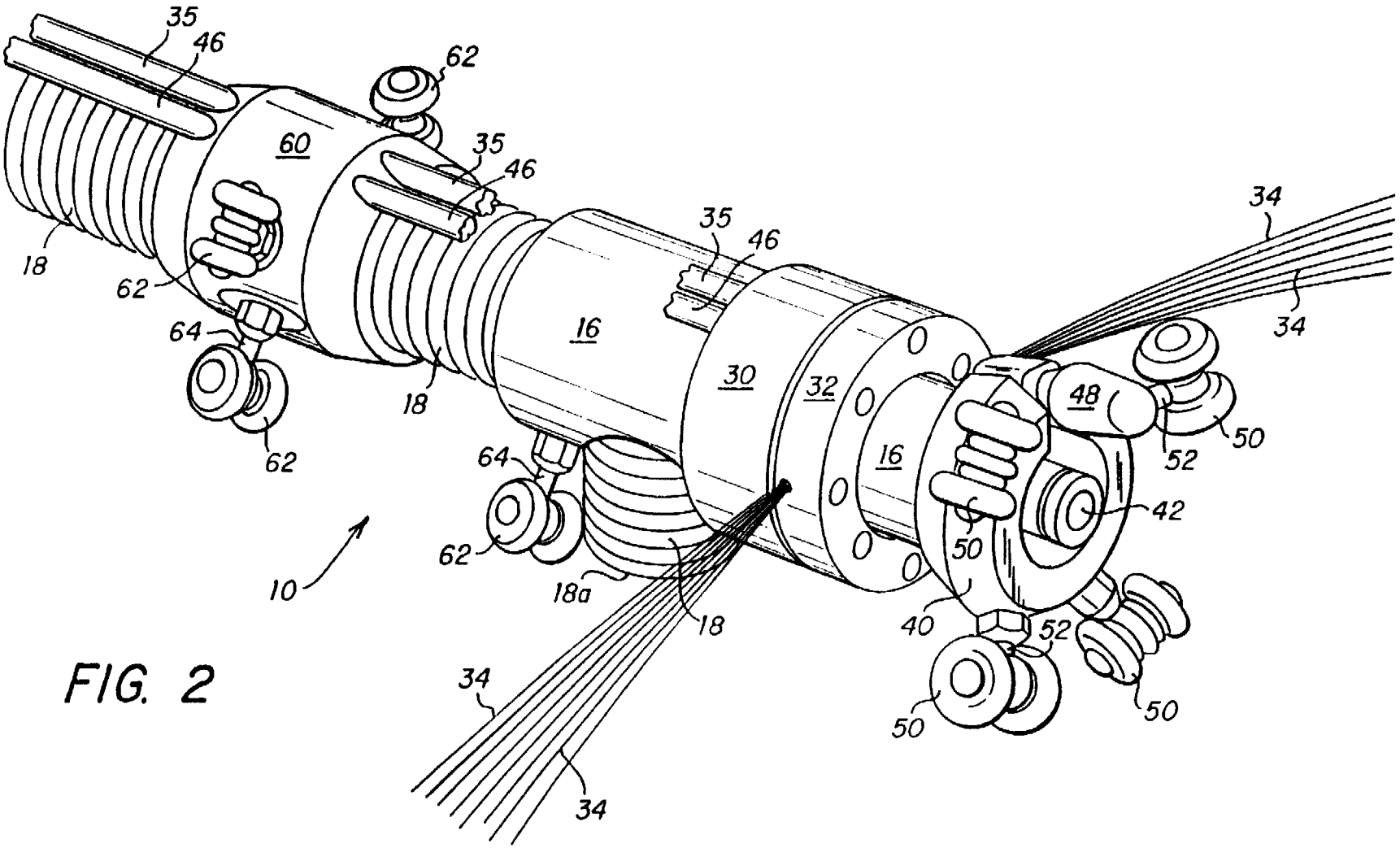
FIG. 2 is an enlarged perspective view of the cleaning head and portion of the vacuum conduit shown in FIG. 1.

Referring simultaneously to FIGS. 1 and 2, an air duct cleaning apparatus is illustrated, and is generally identified by the numeral 10. Apparatus 10 is utilized for cleaning ducts, such as for example, a duct 12 illustrated in FIG. 1. As used herein, the term "duct" includes all types of ventilating system conduits, including vents and ducts. Duct 12 is shown encircled with insulating material 14.

Apparatus 10 includes a head, generally identified by the numeral 16. Interconnected to head 16 is a conduit 18 having an intake opening 18*a* and an exhaust opening 18*b*. Dust and other foreign matter contained within duct 12 is removed via conduit 18 by the application of suction applied by a vacuum source 20. Disposed within vacuum source 20 is a container (not shown) for the deposit of dust and particles removed from duct 12.

Mounted forward of head 16 is a rotor 30 which is interconnected to a hub 32. Interconnected to hub 32 are a plurality of brushes 34. Brushes 34 are caused to rotate through operation of rotor 30 in order to sweepingly engage the interior surfaces of air duct 12 thereby removing dust and foreign material from the interior surfaces of duct 12. Rotor 30 is caused to rotate by air pressure supplied to rotor 30 via a pipe 35. Air pressure may be generated from a source 36. Pipe 35 extends along the entire length of conduit 18 to source 36.

Attached to head 16 is a housing 40. Mounted within housing 40 is a video camera 42 which provides electronic signals necessary to create a video image of the interior surfaces of duct 12. The image generated by camera 42 is displayed on a video camera monitor 44 (FIG. 1). Monitor 44 provides a real time display of the interior or duct 12 during a cleaning operation. A camera cable 46 interconnects camera 42 with monitor 44. Camera 42 may comprise, for example, a micro video camera manufactured and sold by Panasonic, Model No. GP-KS102.

Housing 40 also includes an illumination source 48 for providing illumination for camera 42. Also disposed circumferentially around housing 40 are a plurality of height adjustment wheels 50. Height adjustment wheels 50 are mounted to housing 40 via a threaded shaft 52. Wheels 50 provide height adjustment and centering for housing 40 within duct 12 in order to center camera 42 within duct 12 during the cleaning operation. Wheels 50 are threaded along shafts 52 depending upon the location wheels 50 will be positioned with respect to housing 40. Wheels 50 will engage the interior of duct 12 at several locations in order to maintain housing 40 centered within duct 12.

Located along conduit 18 and periodically spaced apart is a conduit ring 60, only one such ring 60 being illustrated in the Figures. Conduit ring 60 supports pipe 35 and cable 46 along conduit 18. Circumferentially disposed around ring 60 are a plurality of adjustable wheels 62. Wheels 62 are supported on threaded shafts 64. Wheels 62 assist conduit 18 when moving through duct 12 during cleaning operations. Wheels 62 are adjusted along threaded shafts 64 depending upon the diameter of duct 12.

Through operation of the apparatus 10, real time viewing of the interior of duct 12 can be accomplished using camera 42 and monitor 44. Monitor 44 is disposed at a location remote from duct 12 to allow for easily viewing of monitor 44 in order to monitor the cleaning operation in real time. As head 16 is removed from duct 12, the effectiveness of the cleaning operation can be viewed via camera 42 and monitor 44. Camera 42 is mounted forward of brushes 34 so that dust and debris do not interfere with the operation of camera 42 as such dust and debris is removed from the interior surfaces of duct 12. Video camera monitor 44, vacuum source 20 and air source 36 may be mounted to a cart 70 for ease in maneuvering these components of the apparatus 10.

Figure 3:
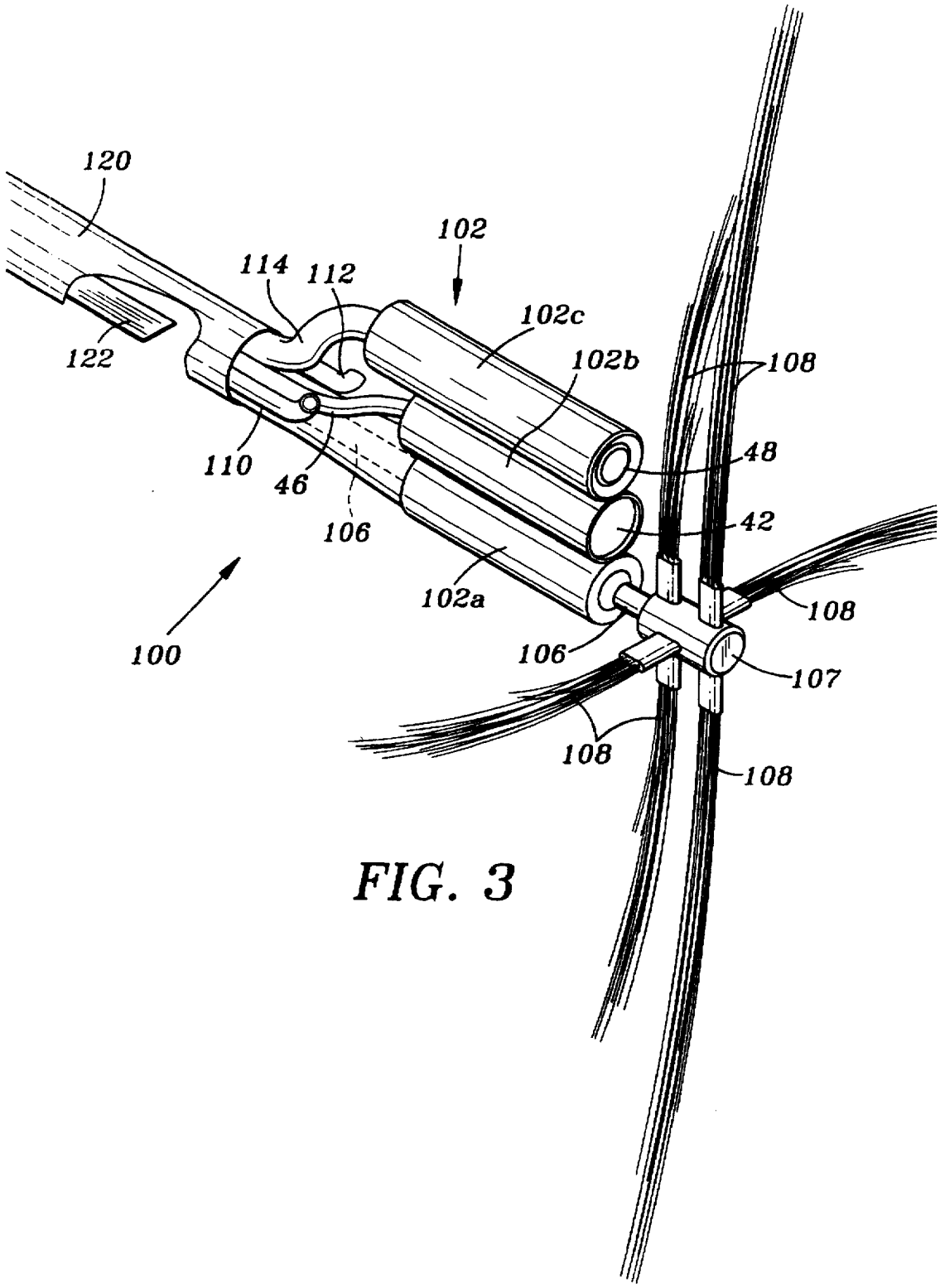
FIG. 3 is a perspective view of the present duct cleaning apparatus.

Referring now to FIG. 3, the present air duct cleaning apparatus is illustrated, and is generally identified by the numeral 100. Apparatus 100 includes a housing, generally identified by the numeral 102, which includes three sections 102*a*, 102*b*, and 102*c*. Housed within section 102*b* is camera 42 (FIG. 2). Housed within section 102*c* is illumination source 48 (FIG. 2). Extending through section 102*a* of housing 102 is a rotatable shaft 106. A hub 107 is mounted to shaft 106. A plurality of brushes 108 are mounted to hub 107. Brushes 108 are caused to rotate through operation of rotating shaft 106 in order to sweepingly engage the interior surfaces of air duct 12, thereby removing dust and foreign material from the interior surfaces of duct 12.

Located rearwardly of housing 102 is an air jet nozzle 110, which supplies a stream of air to the area adjacent housing 102 in order to maintain dust and foreign material removed from the interior surfaces of duct 12 airborne within duct 12. The dust and foreign material is removed from duct 12 using the ventilation system which includes duct 12. For example, the suction created within duct 12 when an air conditioning system is actuated, will move airborne dust and foreign material through duct 12 to a filter within the ventilation system for removal. Alternatively, a vacuum source can be attached to the ventilation system for moving airborne removed dust and foreign material from the interior surfaces of duct 12.

Also located rearwardly of housing 102 is a disinfectant sprayer 112, which dispenses disinfectant into the duct work after cleaning has taken place. The disinfectant is usually sprayed as brushes are withdrawn from the duct work.

Shaft 106, camera cable 46, a power supply cable 114 connected to illumination source 48 and cables attached to air jet nozzle 110 and sprayer 112 are housed within a sleeve 120. Sleeve 120 is pushed through duct 12, and maintains all components extending from housing 102 in a compact configuration. Attached to sleeve 120 is stiffening material 122 such as, for example, a metal tape, so that housing 102 can be easily moved through duct 12.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. An apparatus for cleaning interior surfaces of an air duct, the air duct having a length, the apparatus comprising:

a housing having a first-aperture and said housing first aperture having a centrally disposed axis in a direction along the length of the air duct;

said housing having a second aperture and said housing second aperture having a centrally disposed axis in a direction along the length of the air duct;

brushes mounted adjacent to and forward of said housing for sweeping engagement with the interior surfaces of the air duct, said brushes being mounted for rotation around said housing first aperture axis;

a video camera disposed within said housing second aperture and along said housing second axis and spaced rearward of said brushes for generating an image of the interior of the air duct along the length of the air duct;

means connected to said video camera for displaying said image generated by said video camera during an air duct cleaning operation, said display means being located remote from said housing;

said brushes mounted to a shaft extending through said housing first aperture, said shaft being rotatable for moving said brushes within the air duct;

a sleeve circumferentially surrounding said shaft; and means for stiffening said sleeve for enabling said shaft and said housing to move through the air duct.

2. The apparatus of claim 1 and further including means for directing an air stream in the air duct.

* * * * *

UNITED STATES PATENT AND TRADEMARK OFFICE

CERTIFICATE OF CORRECTION

PATENT NO : 5,735,016

DATED : April 7, 1998

INVENTOR(S) : Bobby L. Allen and Joseph V. Melendres

It is certified that error appears in the above-identified patent and that said Letters Patent is hereby corrected as shown below:

Column 3, line 24, change "48 (FIG. 2)." to --48.--

IN THE CLAIMS

Column 4, line 19, change "first-aperture" to --first aperture--.

Signed and Sealed this

Eighteenth Day of May, 1999

*Attest:*

Q. TODD DICKINSON

*Attesting Officer*

*Acting Commissioner of Patents and Trademarks*